United States Patent [19]

Kamiya et al.

[11] Patent Number: 4,519,099

[45] Date of Patent: May 28, 1985

[54] HELMET

[75] Inventors: Tadashi Kamiya; Kazuhiro Kawasaki; Akio Muranaka, all of Saitama, Japan

[73] Assignee: Honda Giken Kogyo Kabushiki Kaisha, Tokyo, Japan

[21] Appl. No.: 527,983

[22] Filed: Aug. 31, 1983

[30] Foreign Application Priority Data

Sep. 3, 1982 [JP] Japan ..... 57-133885[U]

[51] Int. Cl.[3] ..... A42B 1/08

[52] U.S. Cl. ..... 2/424; 2/425; 2/171.3

[58] Field of Search ..... 2/424, 425, 410, 421, 2/DIG. 1, 195, 191, 177, 171.3, 171.4, 171.5, 171.7, 181.4, 181.6, 184.5, 182.2, 182.3, 6, 5, 10, 12

[56] References Cited

U.S. PATENT DOCUMENTS

| | | | |
|---|---|---|---|
| 888,902 | 5/1908 | Jaillet et al. | 2/171.5 |
| 1,338,283 | 4/1920 | Bradley | 2/184.5 X |
| 1,610,745 | 12/1926 | Castanaro | 2/195 |
| 1,818,765 | 8/1931 | Silverstein | 2/171.5 |
| 3,721,994 | 3/1973 | De Simone et al. | 2/10 X |
| 3,783,450 | 1/1974 | O'Connor | 2/421 |
| 3,925,821 | 12/1975 | Lewicki | 2/425 |
| 4,081,865 | 4/1978 | Bergee et al. | 2/425 |
| 4,115,874 | 9/1978 | Hasegawa | 2/425 |
| 4,153,952 | 5/1979 | Dussich | 2/12 |
| 4,434,514 | 3/1984 | Sundahl et al. | 2/424 X |

FOREIGN PATENT DOCUMENTS

| | | | |
|---|---|---|---|
| 440534 | 1/1936 | United Kingdom | 2/12 |
| 2075820 | 11/1981 | United Kingdom | 2/425 |

*Primary Examiner*—Werner H. Schroeder
*Assistant Examiner*—J. L. Kravitz
*Attorney, Agent, or Firm*—Lyon & Lyon

[57] ABSTRACT

A helmet principally for use with motorcycles and the like having vent openings on the front thereof. The vent openings are positioned within ram cavities formed between the visor and adjacent guide plates. Passageways extend through attachment mechanisms holding the visor to the helmet. Channels extend through the helmet liner to enhance air flow therethrough. Air ducts may be employed within the channels, providing additional energy absorbing properties to the helmet. Air flow may be further increased by means of a channel extension extending rearwardly from the helmet to advantageously arrange the outlets for maximum flow. An adjustable visor having a transparent visor extension enables selected extension and retraction of the visor to meet road and weather conditions.

14 Claims, 12 Drawing Figures

HELMET

BACKGROUND OF THE INVENTION

The field of the present invention is helmets particularly useful for motorcycles and the like.

Modern helmets used for the protection of riders on motorcycles, motorized tricycles and the like generally include a hard resilient outer shell or bowl with a headpad or liner of soft resilient material capable of cushioning the wearer's head from impacts of the bowl against an unyielding object or surface. Such helmets include face openings which optionally may be one opening with the neck opening or may be divided by an extension of the helmet extending across the lower face and chin area.

The nature of the resilient liner material is such that it also exhibits heat insulating properties. These properties which generally are unavoidable where high energy absorbing material is used can result in discomfort to the wearer when worn for extended periods. This results from the retention of the body heat generated by the wearer in the helmet.

To alleviate heat retention and wearer discomfort, holes have been employed which extend through the bowl of the helmet and through or between the liner. The extent, location and open area provided by such holes can provide more or less effective venting. However, where larger or substantial numbers of holes are employed, structural weakness can occur in the helmet. With fewer and smaller holes, the helmets directed to use with motorcycles and the like exhibit adequate structural properties but are less efficient at reducing heat buildup within the helmet. Adding to this difficulty is the tendency of air flow past the helmet to bridge across such vent holes at any substantial speed.

Another difficulty faced by motorcycle helmets which employ visors is that some fastening means is generally employed to retain the visors in position. Most designs directed to helmets with removable visors have additional holes through the bowl for mounting purposes. Some further restriction on the number of vent holes may be imposed because of the presence of mounting holes.

Also associated with helmets with visors is the relative inability of the visor to accommodate different road conditions. Naturally, visors may be replaced. However, such replacement becomes bothersome, particularly if the helmet must be removed or the wearer must stop to effect the change. When mud and rain are anticipated, an extended visor is preferred. However, where more favorable conditions permit, a visor providing less restricted vision is desirable. To require stopping of the vehicle to effect a change of visors to meeting changing road conditions is disadvantageous and troublesome to the wearer.

SUMMARY OF THE INVENTION

The present invention pertains to helmets having particular utility for wearing while riding a motorcycle or other similar vehicle. In a first aspect of the present invention, the problem of improving the efficiency of cooling the interior of the helmet is addressed. To this end, guide plates are employed in conjunction with the helmet visor to form areas of high pressure when the helmet is moving forward through the air. Passageways extend from such high pressure areas interior to the helmet bowl. Greater air flow through the interior of the helmet is then experienced.

In another aspect of the present invention, channels are provided in the liners of such helmets to direct air introduced through passages extending interior to the bowls of such helmets through the helmets and eventually terminating at the back of the helmet at an area of lower pressure. A plurality of such channels may be employed in association with passages or holes through the helmet. Additional guide plates and passages may add to the effective cooling of such helmets. Additional channel extensions may extend rearwardly to exhaust the channels in an even lower pressure condition located a short distance behind the helmet.

In a further aspect of the present invention, visors capable of facile adjustment permit rapid and convenient accommodation to changing road conditions. To this end, visor extensions are adjustably mounted to slide toward and away from the helmet by attachment mechanisms. In this way, adjustment can be made to the visor mechanism to increase the unobstructed field of view or increase the protection from rain, mud and the like. Such attachment mechanisms include slots associated with fasteners to give the visor extension the advantageous flexibility.

Accordingly, an object of the present invention is to provide an improved helmet having improved cooling properties.

Another object of the present invention is to provide an improved helmet having an adjustable visor mechanism.

Other and further objects and advantages will appear hereinafter.

DETAILED DESCRIPTION OF THE PREFERRED EMBODIMENT

Figure 1:
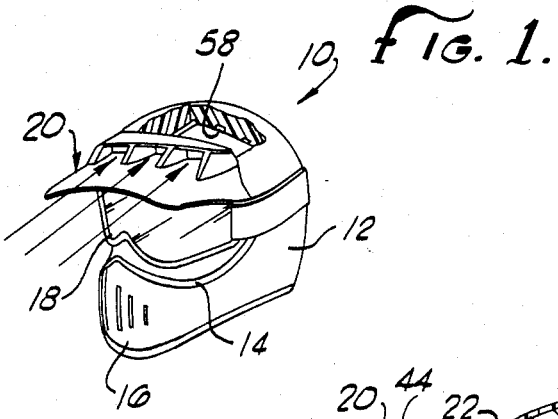
FIG. 1 is an oblique view of a helmet of one embodiment of the present invention.

Turning in detail to the drawings, FIG. 1 illustrates a helmet, generally designated 10, of the type having a bowl 12 with a face opening 14. A lower face guard 16 extends to separate the face opening 14 from the neck opening at the underside of the helmet. Goggles 18 may be employed to protect the wearer's eyes. A visor assembly 20 is fitted to the front of the helmet 10. Liner material is illustrated in the cut-away portion of the helmet.

Figure 2:
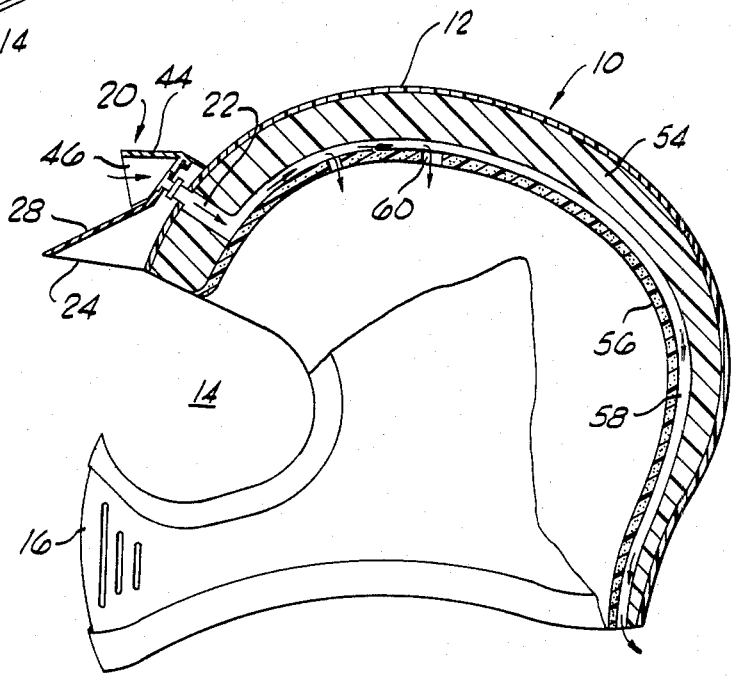
FIG. 2 is a cross-sectional side view of a helmet of the present invention.
Figure 3:
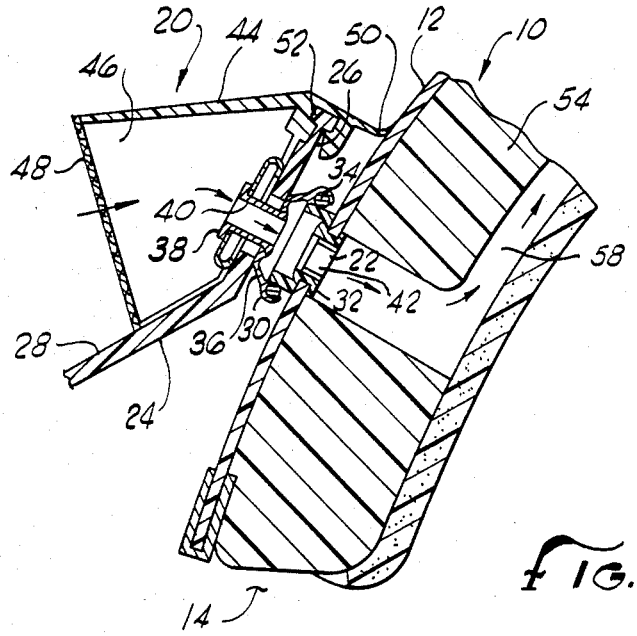
FIG. 3 is a detailed cross-sectional view of the helmet of FIG. 2.

Looking then to the specific embodiment of FIGS. 2 and 3, passages 22 extend through the bowl 12. These passages 22 thereby form openings through which air can pass to ventilate the interior of the helmet 10. The passages 22 are arranged in association with the visor assembly 20.

The visor assembly 20 is installed on the front side of the bowl 10 adjacent to the face opening 14. The assembly includes a visor 24 including a visor mount 26 extending roughly parallel to the most adjacent portion of the bowl 12 and a visor plate 28. The visor plate 28 extends outwardly from the visor mount away from the bowl 12 to form the shield portion of the assembly. The visor mount 26 and visor plate 28 are conveniently of unitary construction and are curved to conform to the bowl 12 and arranged to provide an appropriate shield.

Visors have commonly been mounted by means of snap mechanisms to the bowl 12 of helmets 10. Snap mechanisms 30 are employed for the mounting of the visor assembly 20 to the bowl 12 of the helmet 10. The snap mechanisms include a grommet 32 having an annular rib 34. The grommet 32 is fixed to the bowl 12 as illustrated. An annular hook mechanism 36 is designed to resiliently engage and interlock with the annular rib 34. The annular hook mechanism 36 is also fixed by means of a grommet 38 to the visor assembly 20. By this mechanism, the visor assembly 20 may be securely held on the helmet 10 and yet be removable when desired.

According to the present invention, the grommets 32 and 38 of each snap mechanism 30 include a central hole therethrough which cooperate to form the passage 22. These holes 40 and 42 are aligned to provide relatively unrestricted air flow therethrough. In this way, air may pass through the visor mount 26 and through the bowl 12. Through use of the snap mechanisms for defining passages extending interior to the bowl of the helmet 10, one hole is able to serve two functions. This allows a reduction in the number of holes necessary in the helmets.

Associated with the visor assembly 20 is a guide plate 44. The guide plate 44 is adjacent and spaced from the visor plate 28 as can best be seen in the Figures. In the embodiment of FIGS. 2 and 3, the guide plate 44 is located above the visor plate 28 such that the visor plate 28 is between the guide plate 44 and the face opening 14. The guide plate 44 also extends outwardly from the helmet 10 in a forwardly direction. Ribs 46 aligned generally normal to the guide plate 44 extend between the guide plate 44 and the visor plate 28. The ribs 46, along with the guide plate 44 and the visor plate 28 define cavities therebetween. The cavities thus defined open forwardly of the helmet 10 to receive air as indicated by the arrows in all of FIGS. 1–3. When the wearer is moving forwardly through the air, for example on a motorcycle, air pressure increases in the cavities between the guide plate 44 and the visor plate 28. This pressure increase is also exerted against the visor mount 26. As a result, air flow is increased through the passages 22 defined by holes 40 and 42. Increased air flow is thereby directed inwardly of the bowl 12 of the helmet 10. The cavities may be protected by a porous mud guard 48 designed to restrict liquid flow therethrough, block mud and yet allow relatively unobstructed air flow.

Structurally, the guide plate 44 is preferably of a plastic material having some resiliency such that a thin edge abutting the bowl 12 of the helmet 10 will form a resilient sealing flange at 50. The guide plate 44 is assembled with the visor 24 by means of a tenon and mortise mechanism at 52.

Interior of the bowl 12 in the helmet 10 is a liner 54. The liner 54 is of resilient material capable of absorbing substantial shock loads. In this way, it is able to protect the wearer from substantial impact. Inwardly of the liner 54 is a headband 56 which is preferably of a somewhat porous and moisture absorbant material for wearer comfort. The headband 56 is also shown to line the interior of the helmet 10 inwardly of the liner 54.

The passages 22 extend through the liner 54 as can be seen in the figures. The passages 22 are in communication with channels 58 which extend at least from the passages 22 to the back portion of the helmet 10 to achieve substantial air flow throughout the helmet 10. The channels 58 in this first embodiment are simply cut into the body of the liner 54 and are covered over by the headband 56.

Figure 8:
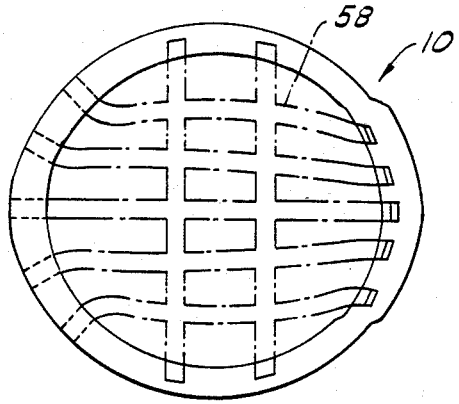
FIG. 8 is a bottom view of a helmet illustrating a pattern of channels which may be employed with the foregoing embodiments.

The air pressure at the discharge location of the channels 58 is lower than that of the cavities in communication with the passages 22 when the wearer is moving forwardly through the air. Thus, flow is induced as represented by the arrows in the figures. Vents 60 extending laterally through the headband allow some air flow into the interior of the headband 56 to further purge hot air and moisture from the interior of the helmet. The channels 58 are generally shown to be parallel running from the passages 22 to the back of the helmet. However, as illustrated in FIG. 8, transverse channels may also be employed to further distribute air through the helmet 10.

Figure 4:
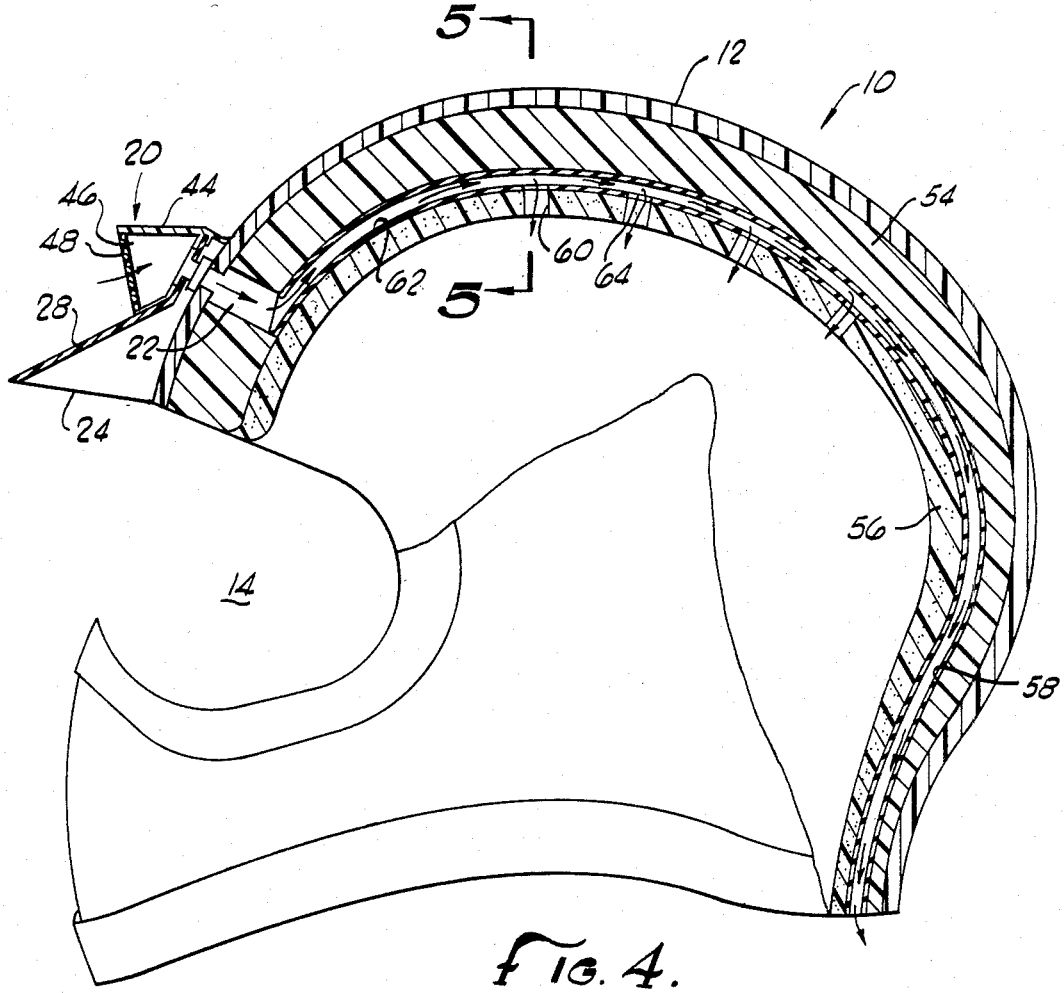
FIG. 4 is a cross-sectional side view of a second embodiment of the present invention.
Figure 5:
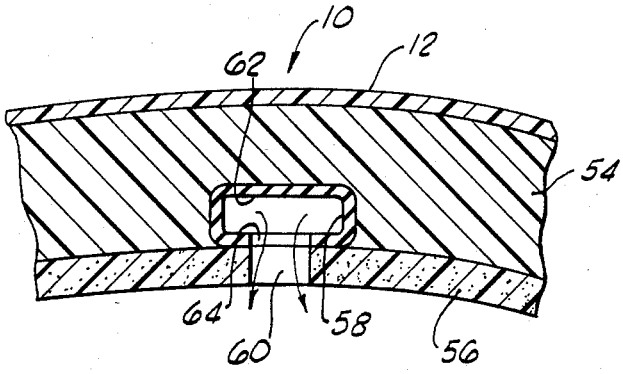
FIG. 5 is a cross-sectional view taken along line 5—5 of FIG. 4.

Turning next to the embodiment of FIGS. 4 and 5, similar reference numerals have been employed for similar elements and further discussion of those elements will generally be limited to variations from prior embodiments.

Inserted within the channel 58 is an air duct 62. The air duct 62 is preferably of a resilient, energy absorbing material to provide added energy absorbing properties to the overall liner arrangement at locations where the channels 58 reduce the thickness of energy absorbing liner material. At the same time, air flow may not otherwise be restricted. Holes 64 line with vents 60 for the passage of air into the interior of the helmet 10 inwardly of the headband 56.

Figure 6:
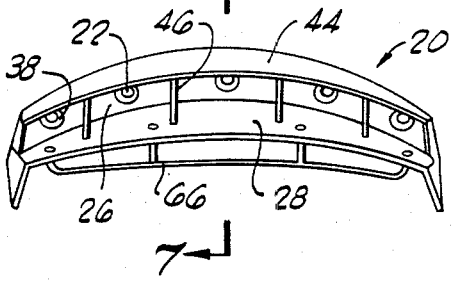
FIG. 6 is a front view of a visor assembly of yet another embodiment of the present invention.
Figure 7:
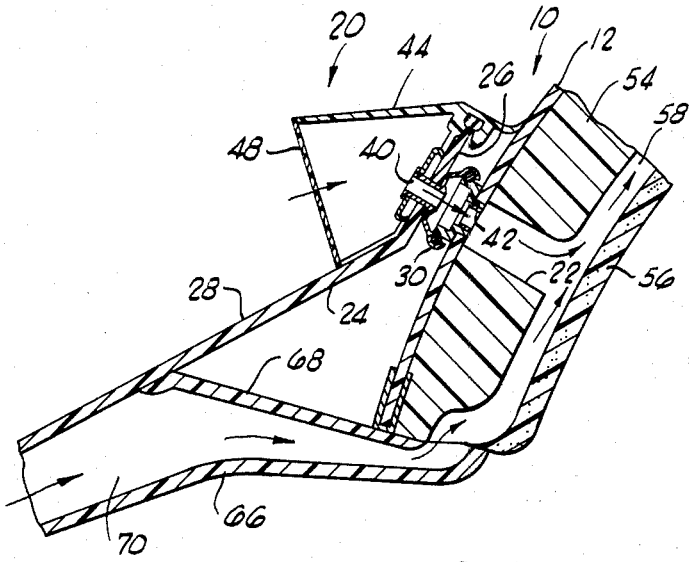
FIG. 7 is a cross-sectional elevation of a visor and helmet taken along line 7—7 of FIG. 6.

Looking next to the embodiment of FIGS. 6 and 7, an additional guide plate 66 is illustrated. The guide plate 66 is positioned on the opposite side of the visor plate 28 from the guide plate 44. This additional guide plate 66 extends inwardly interior to the bowl 12 at the face opening 14. A seal is defined at the end of the guide plate 66 where it meets with the headband 56. An inner plate 68 streamlines the passage 70 defined between the guide plate 66 and the visor plate 28 by eliminating the portion upwardly of the inner plate 68 from the passage 70. The channel 58 extends beyond the passage 22 to communicate with the passage 70 as can best be seen in FIG. 7. Through the employment of the guide plate 66 to define the passage 70, increased cooling is available to the wearer's forehead area. Additionally, greater ram frontal area is thus defined. Naturally, the passage 70 may be employed independently of any passage 22 where desirable.

Figure 9:
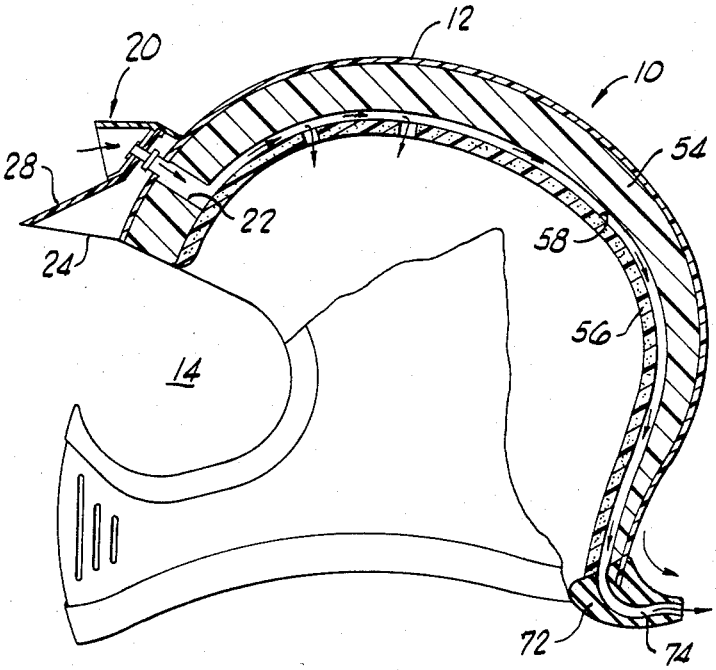
FIG. 9 is a cross-sectional side elevation of a helmet of the present invention illustrating yet another embodiment thereof.

Turning next to the embodiment of FIG. 9, a channel extension 72 is positioned on the rear of the helmet 10. The channel extension 72 includes passageways 74 in communication with the channels 58. The channel extension 72 extends rearwardly from the helmet 10 to obtain the benefit of reduced pressure resulting from the flow of air around the helmet 10. A reduction in the pressure behind the helmet further acts to draw air through the vent system within the helmet 10.

Figure 10:
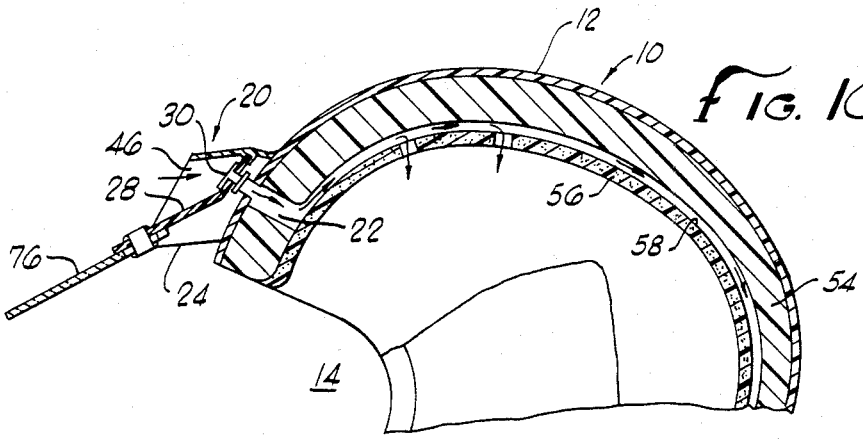
FIG. 10 is a cross-sectional elevation of another embodiment of the present invention.
Figure 11:
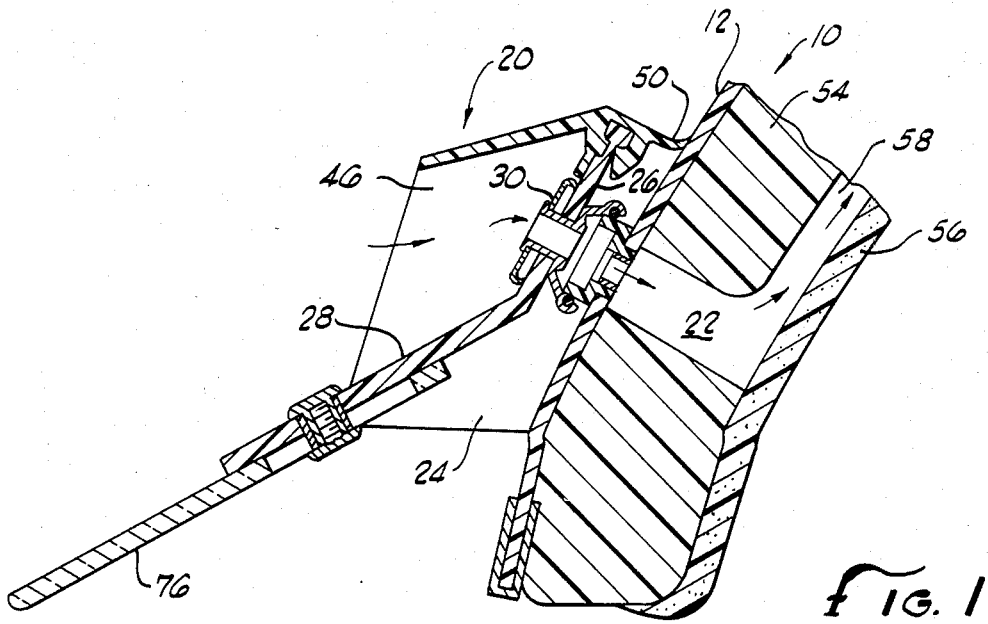
FIG. 11 is a cross-sectional detail of the device of FIG. 10.
Figure 12:
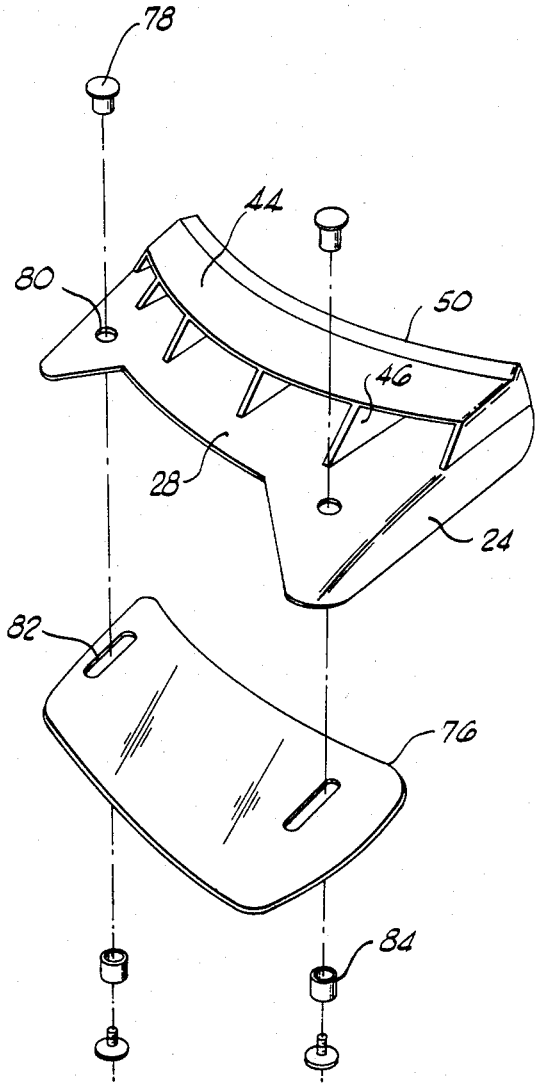
FIG. 12 is an exploded view of the visor mechanism of the embodiment of FIG. 10.

Looking lastly to the embodiment of FIGS. 10, 11 and 12, an adjustable visor is disclosed. The adjustable visor includes a transparent visor extension 76. The transparent visor extension 76 is positioned against the visor plate 28 and held there by an attachment mechanism. The attachment mechanism includes fasteners 78 extending through holes 80 in the visor plate 28. The attachment mechanism also includes slots 82 extending parallel to the direction of preferred movement of the transparent visor extension 76. The fasteners 78 extend through the slots 82 to retain the visor extension 76 in slidable juxtaposition with the visor plate 28. Grommets 84 may be employed through the slots 82 to provide some interference to motion of the transparent visor extension 76. Adjustment to the visor extension may be readily made and yet the resistance to such movement will maintain the adjusted position.

Accordingly, an improved helmet has been disclosed capable of increasing air flow through the helmet. An improved visor capable of being adjusted to meet road and weather conditions is also disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A helmet having a face opening comprising, a detachable visor assembly including a visor plate extending outwardly from the front of the helmet above the face opening, inlet air guide means adjacent said visor plate forming a plurality of frontal air pressure cavities with said visor plate, and the helmet having a plurality of interior venting channels connecting to inlet air at said frontal air pressure cavities and exiting air at the rear of said helmet.

2. The helmet defined in claim 1 wherein said inlet air guide means comprises an upper guide plate positioned above and spaced from said visor plate and upper ribs positioned between said visor plate and said upper guide plate to form a plurality of cavities above said visor plate.

3. The helmet defined in claim 2 wherein said inlet air guide means further comprises, a lower guide plate positioned below and spaced from said visor plate and lower ribs positioned between said visor plate and said lower guide plate to form a plurality of cavities below said visor plate.

4. The helmet defined in claim 2 further comprising connecting means detachably mounting said detachable visor on said helmet, said connecting means including inlet air openings into said cavities.

5. The helmet defined in claim 4 wherein said connecting means comprise hollow snap means.

6. The helmet defined in claim 2 further comprising an air porous mud guard positioned in front of inlet air openings into said cavities.

7. The helmet defined in claim 1 further comprising a sealing flange at the top of said detachable visor assembly and said helmet to provide a substantially streamlined air flow surface over said helmet.

8. The helmet defined in claim 1 wherein said inner channels further comprise a venting air duct formed of resilient energy absorbing material.

9. The helmet defined in claim 1 further comprising, a visor extension fixed to said visor plate for slidable extension and retraction.

10. A helmet including an outer shell and an inner lining and having a face opening comprising a detachable visor assembly including a visor plate extending outwardly from the helmet above the face opening and inlet air guide means forming a plurality of cavities above said visor plate, the outer shell having front air openings extending from each of said plurality of cavities into the inner liner, and said inner liner having a plurality of interior venting channels connecting to said front air openings and exiting from the back of said helmet.

11. The helmet defined in claim 10 wherein said inlet air guide means comprises a guide plate positioned above and spaced from said visor plate, ribs positioned between said visor plate and said guide plate to form said plurality of cavities above said visor plate.

12. A helmet including an outer shell having a face opening comprising a detachable visor assembly for attachment to the outer shell including a visor plate and forming a plurality of frontal air pressure cavities adjacent said visor plate, and a liner within said outer shell providing a plurality of interior venting channels from the front of said helmet to the rear of said helmet, said channels connecting with said plurality of frontal air pressure cavities.

13. The helmet defined in claim 12 wherein said plurality of frontal air pressure cavities are formed above said visor and said outer shell includes front openings at said upper air pressure cavities connecting with said interior venting channels.

14. The helmet defined in claim 12 further comprising, a rear channel extension means extending said channels at the rear of said helmet to exit in the low pressure area at the rear of said helmet.

* * * * *